US012564304B2

(12) United States Patent
Brewer et al.

(10) Patent No.: US 12,564,304 B2
(45) Date of Patent: Mar. 3, 2026

(54) APPLIANCE HANDLE CLIP FOR SECURING AN APPLIANCE HANDLE IN TRANSPORT

(71) Applicant: Haier US Appliance Solutions, Inc., Wilmington, DE (US)

(72) Inventors: Kyle James Brewer, Louisville, KY (US); Aldo Vincent Kremmel, Palmyra, IN (US); Zachary Wiles, Louisville, KY (US); Pirapat Kitipongpatana, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 47 days.

(21) Appl. No.: 18/526,720

(22) Filed: Dec. 1, 2023

(65) Prior Publication Data

US 2025/0176793 A1 Jun. 5, 2025

(51) Int. Cl.
*A47L 15/42* (2006.01)

(52) U.S. Cl.
CPC ..... *A47L 15/4268* (2013.01)

(58) Field of Classification Search
None
See application file for complete search history.

(56) References Cited

FOREIGN PATENT DOCUMENTS

| | | | |
|---|---|---|---|
| CN | 109363597 | A | 2/2019 |
| CN | 114847835 | A | 8/2022 |
| DE | 1929580 | U | 12/1965 |
| DE | 102013106506 | A1 | 12/2014 |
| DE | 102016110704 | B4 | 8/2022 |
| KR | 20170137475 | A | 12/2017 |

OTHER PUBLICATIONS

CN 114847835 A Espacenet translation, A Handle Conveying Structure of Dishwasher and Dishwasher, Li (Year: 2022).*
DE 102016110704 A1 Espacenet translation, Cable Support, Judin (Year: 2017).*

* cited by examiner

*Primary Examiner* — Cristi J Tate-Sims
(74) *Attorney, Agent, or Firm* — Dority & Manning, P.A.

(57) ABSTRACT

A handle clip may include a mount segment, a support segment, and a connection segment. The mount segment may be securable to the appliance handle. The support segment may extend from the mount segment away from the appliance handle. The connection segment may be joined to the support segment for receipt on a wire frame. The connection segment may include a rigid tab, a clamp tab, and a resilient arc. The rigid tab may extend downward relative to the support segment. The clamp tab may be longitudinally spaced apart from the rigid tab. The clamp tab may be selectively deflectable relative to the rigid tab. The resilient arc joint may extend from the rigid tab to the clamp tab. The connection segment may define a wire groove to receive the wire frame between the rigid tab and the clamp tab.

20 Claims, 7 Drawing Sheets

APPLIANCE HANDLE CLIP FOR SECURING AN APPLIANCE HANDLE IN TRANSPORT

FIELD OF THE DISCLOSURE

The present subject matter relates generally to domestic appliance, such as dishwashing appliances, and more particularly to a handle transport structure for a domestic appliance.

BACKGROUND OF THE DISCLOSURE

Domestic appliances (e.g., dishwashing appliances, refrigerator appliances, oven appliances, etc.) are available in a variety of configurations. However, a common element of many domestic appliances is a door that is movably (e.g., rotatably) mounted to a cabinet or housing. In order to allow a user to open and close the door, a handle is often provided. In the case of dishwashing appliances, handles can generally be divided into two types: exposed handles and hidden handles. For exposed handles, the can be independently placed on the door and connected to the same.

Existing dishwashing appliances are generally shipped as a whole after being assembled. For dishwashers with exposed handles, different product packaging is often caused by the different structural dimensions of the handles. Multiple packaging methods are often needed, which can increase the development cycle, difficulty of manufacturing, or the cost of packaging design. In addition, the handle may be exposed, occupying a large space, and the packaging box required for packaging and transportation is large. Moreover, the handle may be easily damaged during transport.

Some dishwashing appliances having begun being sold or transported with a detachable handle, which can be packed in a box as an accessory during transportation. A consumer or retailer can then mount the handle once the dishwashing appliance has reached its final destination or is otherwise unpacked. Unfortunately, this can still present some challenges. In particular, it can still be easy for the handle to be damaged in transport. If the handle is simply placed within the dishwashing appliance, there is a chance that the interior of the dishwashing appliance may be damaged.

As a result, it would be useful to provide an assembly or appliance addressing one or more of the above issues. For instance, it may be advantageous to provide an assembly capable of safely securing a handle (e.g., apart from an appliance door) during transport.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a handle clip for securing an appliance handle during shipping is provided. The handle clip may include a mount segment, a support segment, and a connection segment. The mount segment may be securable to the appliance handle. The support segment may extend from the mount segment away from the appliance handle. The connection segment may be joined to the support segment for receipt on a wire frame. The connection segment may include a rigid tab, a clamp tab, and a resilient arc. The rigid tab may extend downward relative to the support segment. The clamp tab may be longitudinally spaced apart from the rigid tab. The clamp tab may be selectively deflectable relative to the rigid tab. The resilient arc joint may extend from the rigid tab to the clamp tab. The connection segment may define a wire groove to receive the wire frame between the rigid tab and the clamp tab. The clamp tab may include a T-post at a free end disposed below the wire groove and opposite of the resilient arc joint.

In another exemplary aspect of the present disclosure, a handle clip for securing an appliance handle during shipping is provided. The handle clip may include a mount segment, a support segment, and a connection segment. The mount segment may be securable to the appliance handle. The support segment may extend from the mount segment away from the appliance handle. The connection segment may be joined to the support segment for receipt on a wire frame. The connection segment may include a rigid tab, a clamp tab, and a resilient arc. The rigid tab may extend downward relative to the support segment. The clamp tab may be longitudinally spaced apart from the rigid tab. The clamp tab may be selectively deflectable relative to the rigid tab. The resilient arc joint may extend from the rigid tab to the clamp tab. The connection segment may define a wire groove to receive the wire frame between the rigid tab and the clamp tab. The clamp tab may define a longitudinal aperture apart from the wire groove to receive a fastener therethrough. The rigid tab may define an attachment collar aligned with the longitudinal aperture to receive the fastener with the longitudinal aperture.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
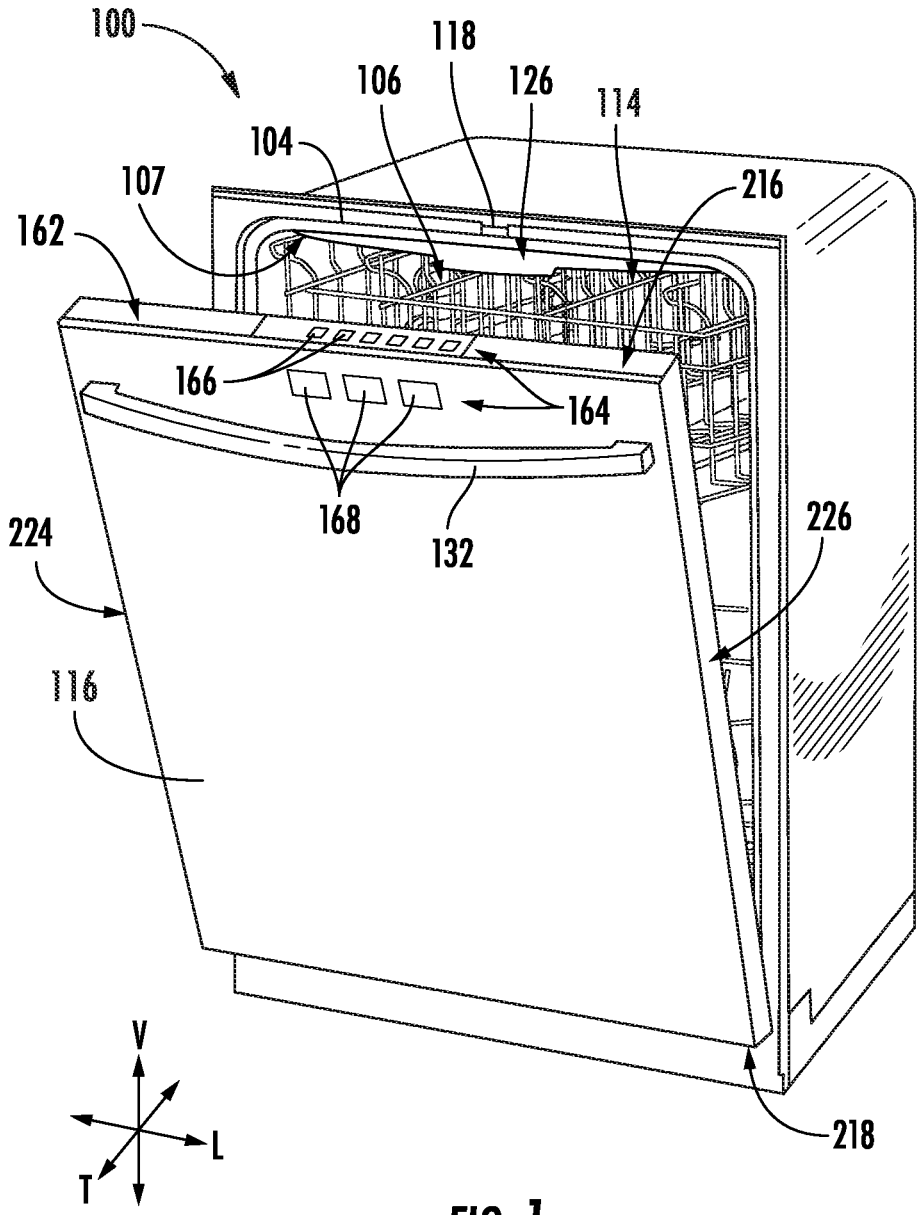
FIG. 1 provides a perspective view of a dishwashing appliance, including a dishwasher door according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents. The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

Figure 2:
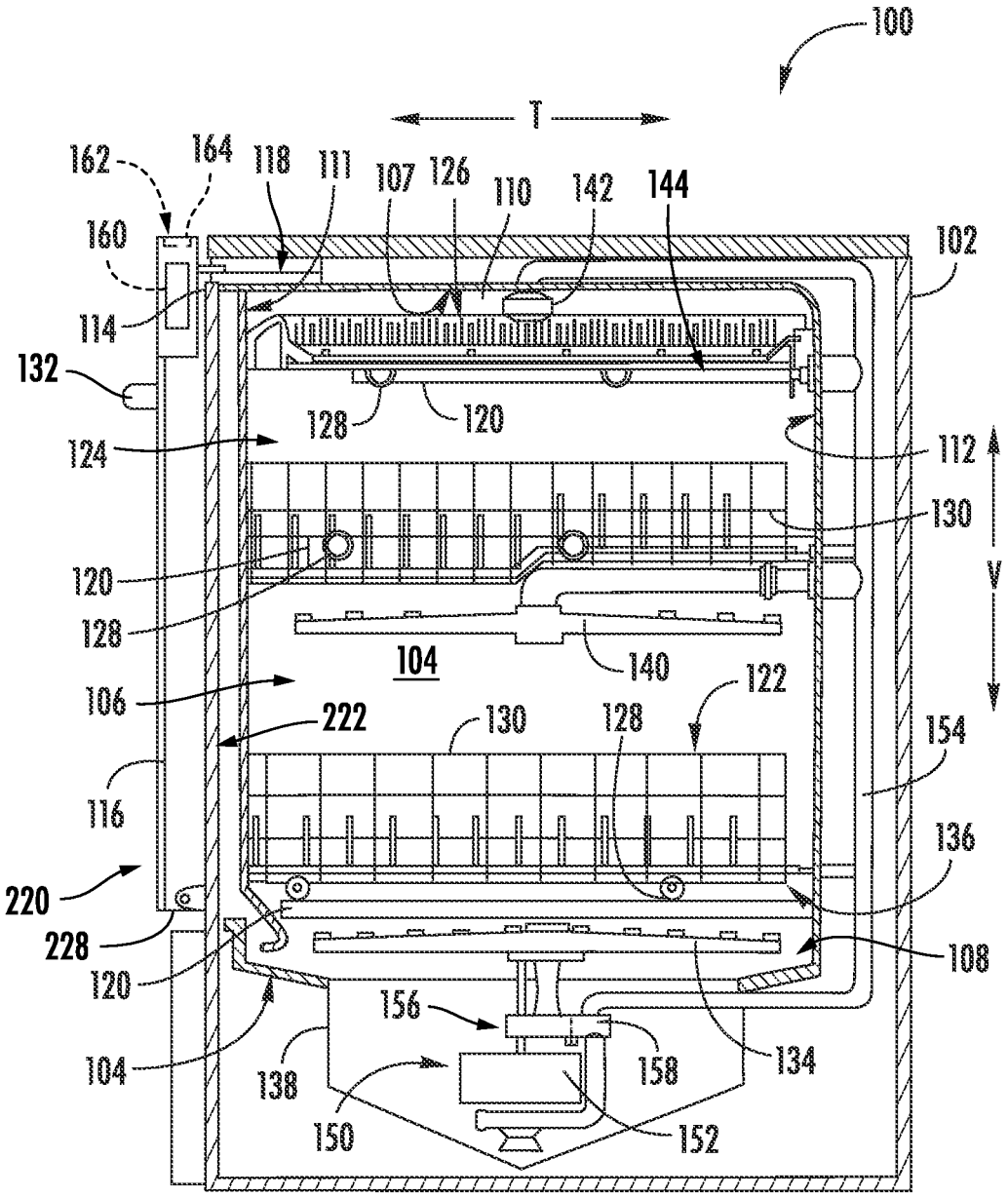
FIG. 2 provides a cross-sectional elevation view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 having a tub 104 therein that defines a wash chamber 106. As shown, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually orthogonal to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. In the normally closed position, door 116 extends from a top end 216 to a bottom end 218 along the vertical direction V; from a front end 220 to a rear end 222 along the transverse direction T; and between two lateral ends 224, 226 along the lateral direction L. A pivot axis 228 may be defined on the door 214 (e.g., by one or more lateral pivot hinges or pins), for example, parallel to the lateral direction L at or proximal to bottom end 218. A handle 132 may be provided (e.g., proximal to top end 216. According to exemplary embodiments, dishwasher 100 further includes a door closure mechanism or assembly 118 that is used to lock and unlock door 116 for accessing and sealing wash chamber 106.

As illustrated in FIG. 2, tub side walls 110 may accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles (e.g., during a cleaning or rinsing cycle). According to another exemplary embodiment, a silverware basket (not shown) may be removably attached to a rack assembly (e.g., lower rack assembly 122) for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water or wash fluid (e.g., detergent, water, or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies (e.g., to mid-level spray arm assembly 140 and upper spray assembly 142). However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump 152 draws wash fluid in from sump 138 and pumps it to a diverter assembly 156 (e.g., which may be positioned within sump 138 of dishwasher appliance 100). Diverter assembly 156 may include a diverter disk (not shown) disposed within a diverter chamber 158 for selectively distributing the wash fluid to the spray arm assemblies 134, 140, 142 or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level or upper spray assemblies 140, 142 (e.g., such as primary supply conduit 154).

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor (e.g., using a combination of discrete analog or digital logic circuitry, such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116, as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel 164 through which a user may select various operational features and modes and monitor progress of the dishwasher 100. In one embodiment, the user interface 164 may represent a general purpose I/O ("GPIO") device or functional block. In certain embodiments, the user interface 164 includes input components 166, such as one or more of a variety of electrical, mechanical or electro-mechanical input devices including rotary dials, push buttons, and touch pads. As shown, one or more user inputs 166 (e.g., buttons) of user interface 164 may be positioned at a top end 216 of door 116 (e.g., on or through a top wall of door 116). The user interface 164 may further include one or more display components 168, such as a digital display device or one or more indicator light assemblies designed to provide operational feedback to a user. The user interface 164 may be in communication with the controller 160 via one or more signal lines or shared communication busses.

It should be appreciated that, except as otherwise specified, the present disclosure is not limited to any particular style, model, or configuration of appliance dishwasher 100. The exemplary embodiment depicted in FIGS. 1 and 2 is for illustrative purposes only.

Figure 3:
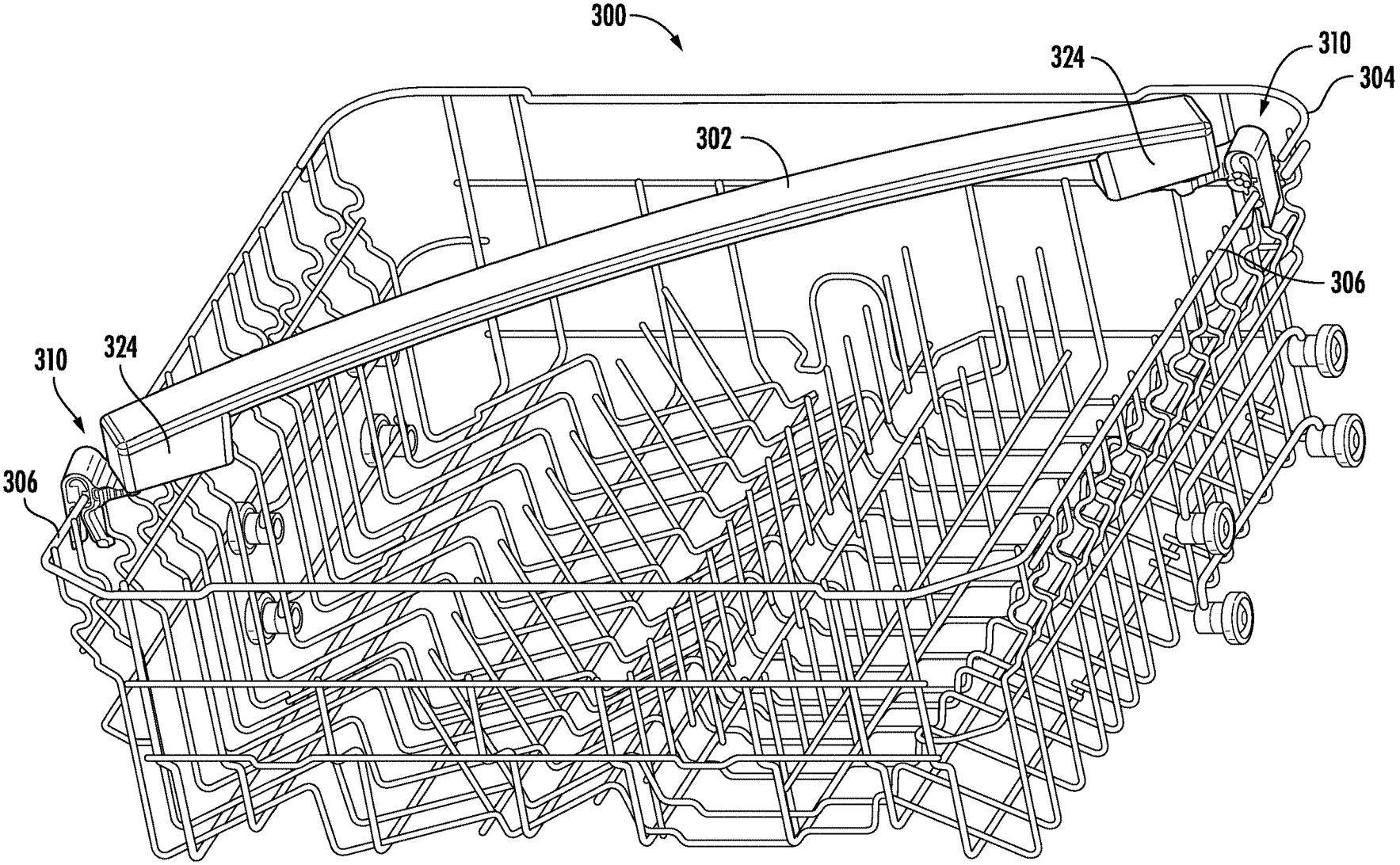
FIG. 3 provides a perspective view of an appliance handle and transport assembly according to exemplary embodiments of the present disclosure.
Figure 4:
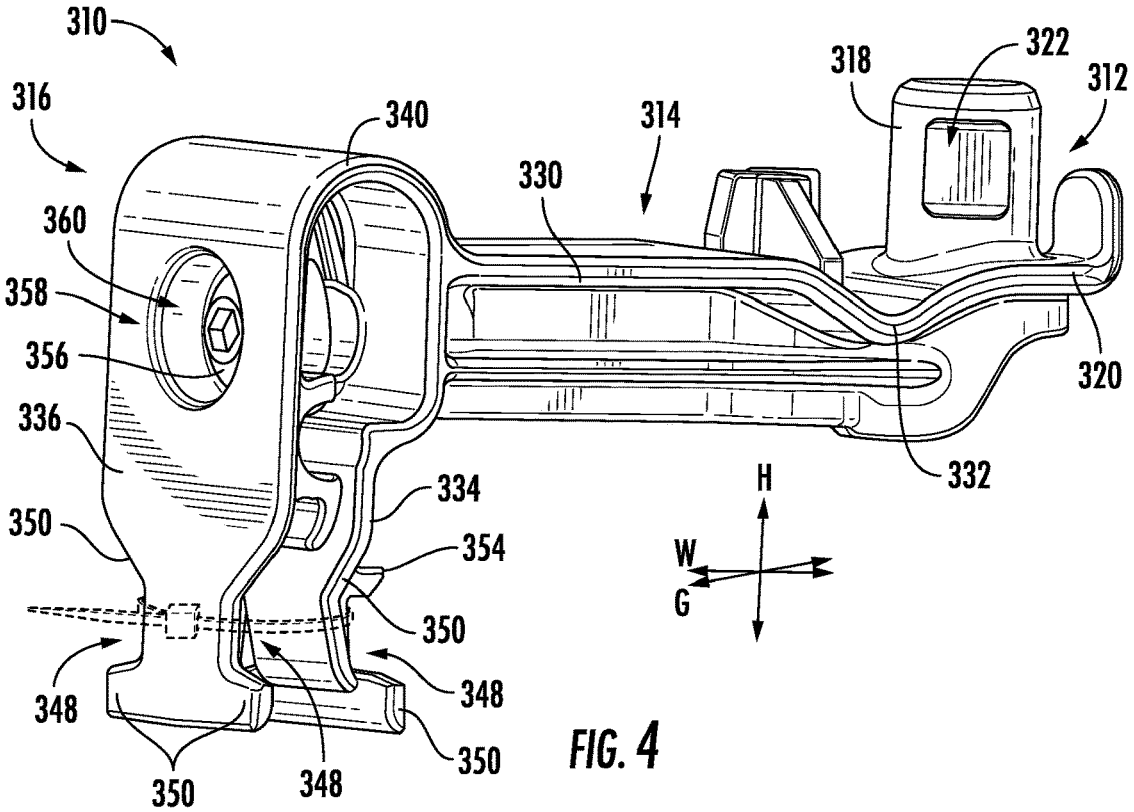
FIG. 4 provides a perspective view of a handle clip for transporting an appliance handle according to exemplary embodiments of the present disclosure.
Figure 5:
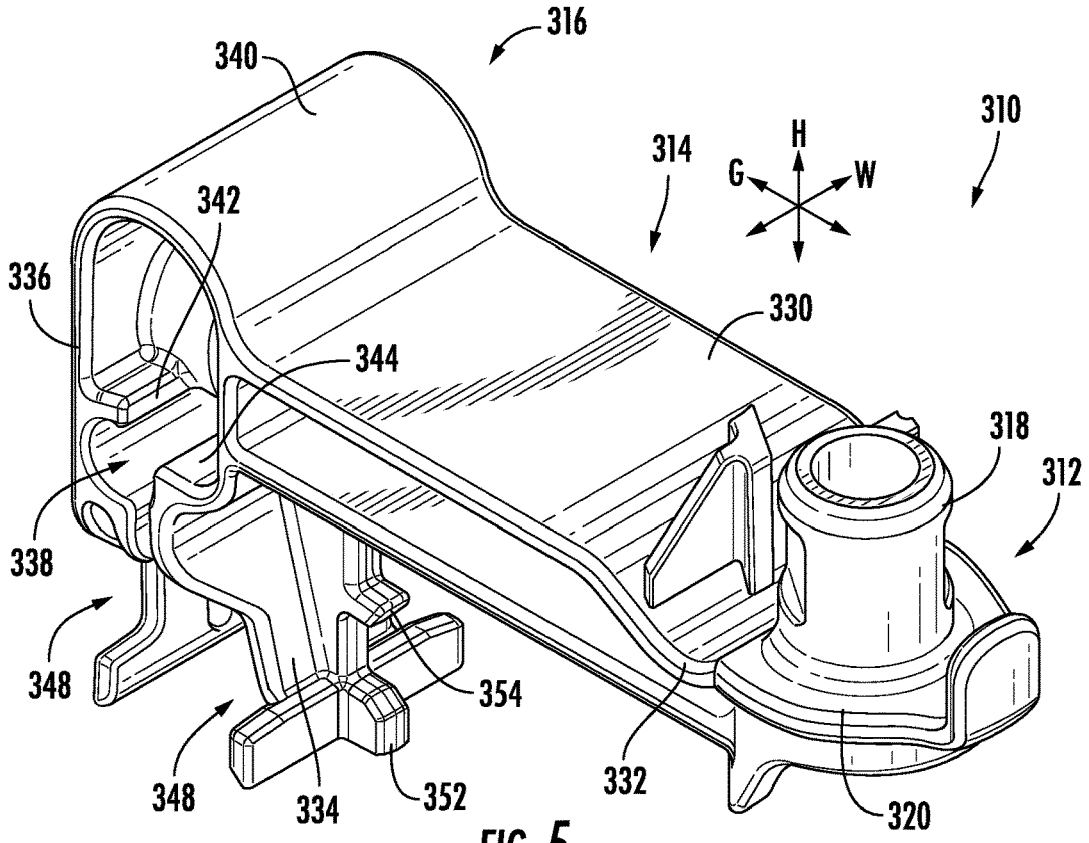
FIG. 5 provides another perspective view of the exemplary handle clip of FIG. 4.
Figure 6:
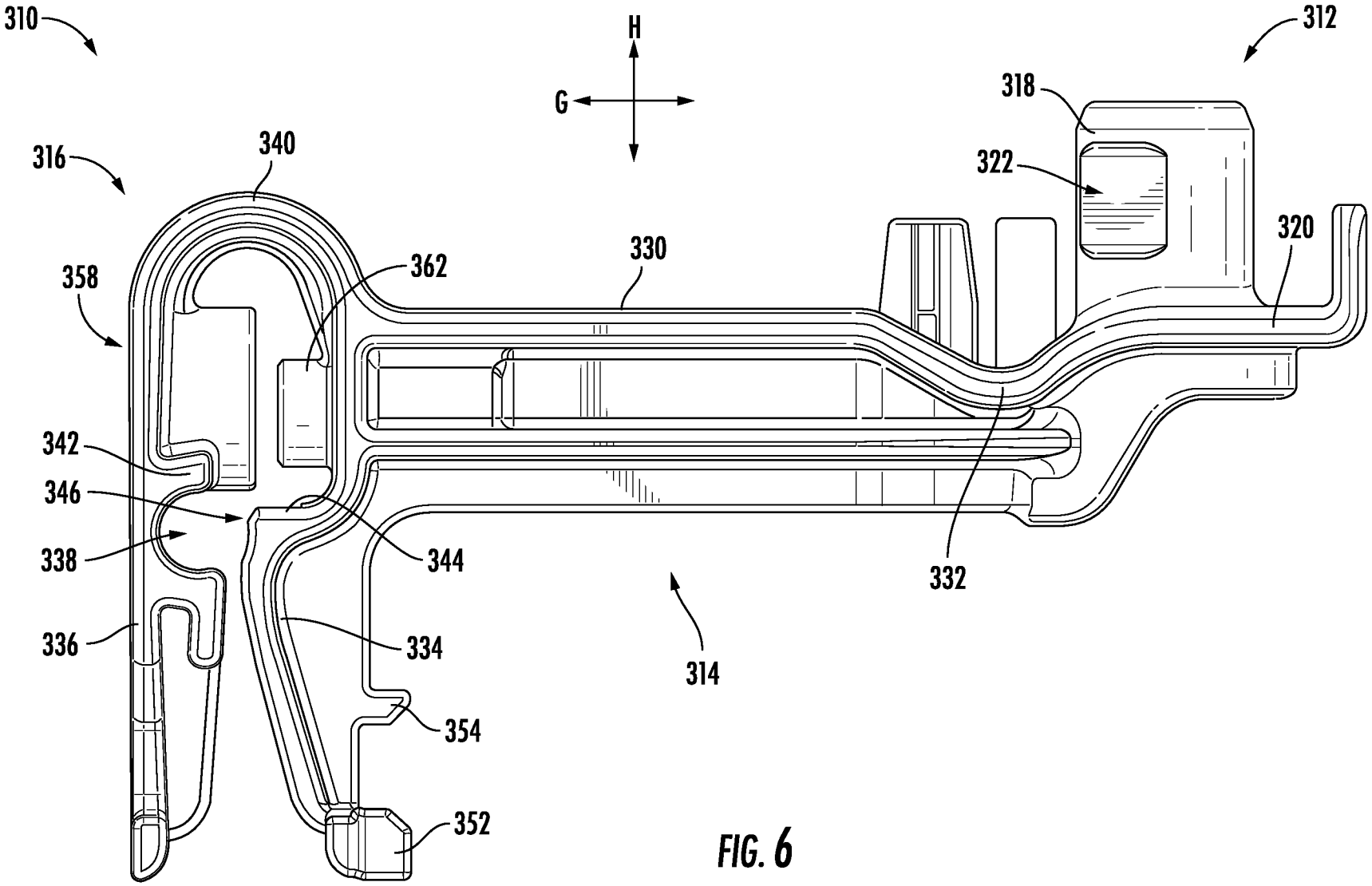
FIG. 6 provides a side elevation view of the exemplary handle clip of FIG. 4.
Figure 7:
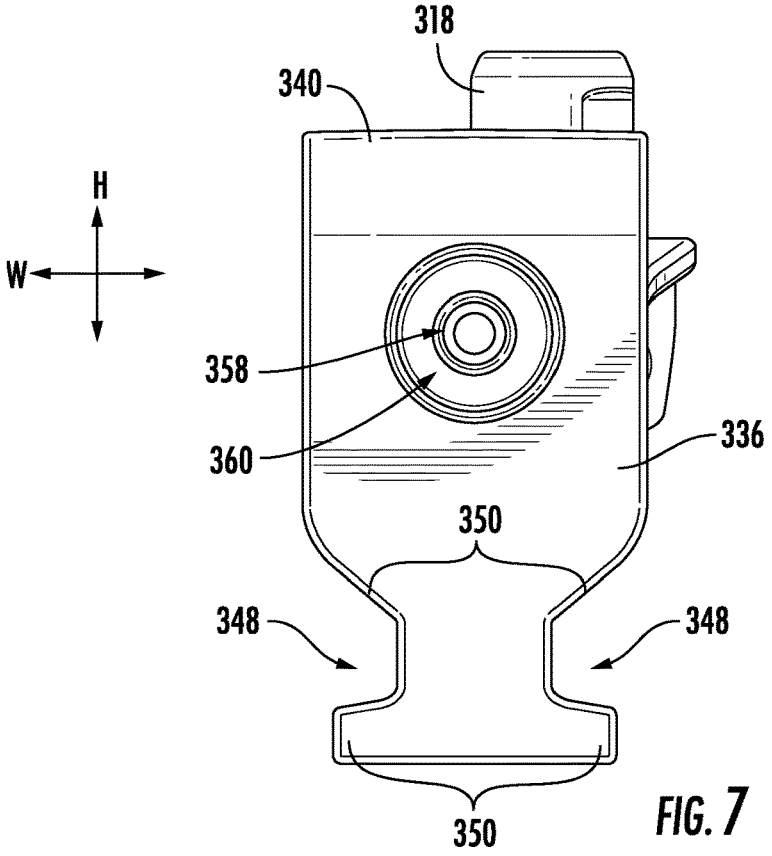
FIG. 7 provides a front elevation view of the exemplary handle clip of FIG. 4.
Figure 8:
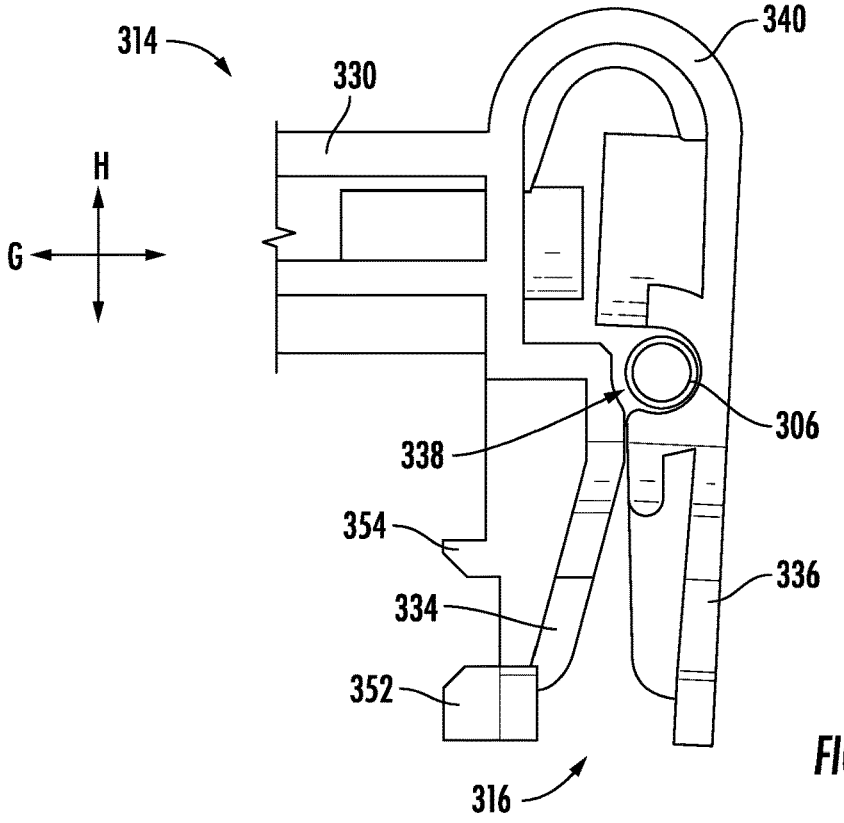
FIG. 8 provides a side elevation view of a portion of the exemplary handle clip of FIG. 4.
Figure 9:
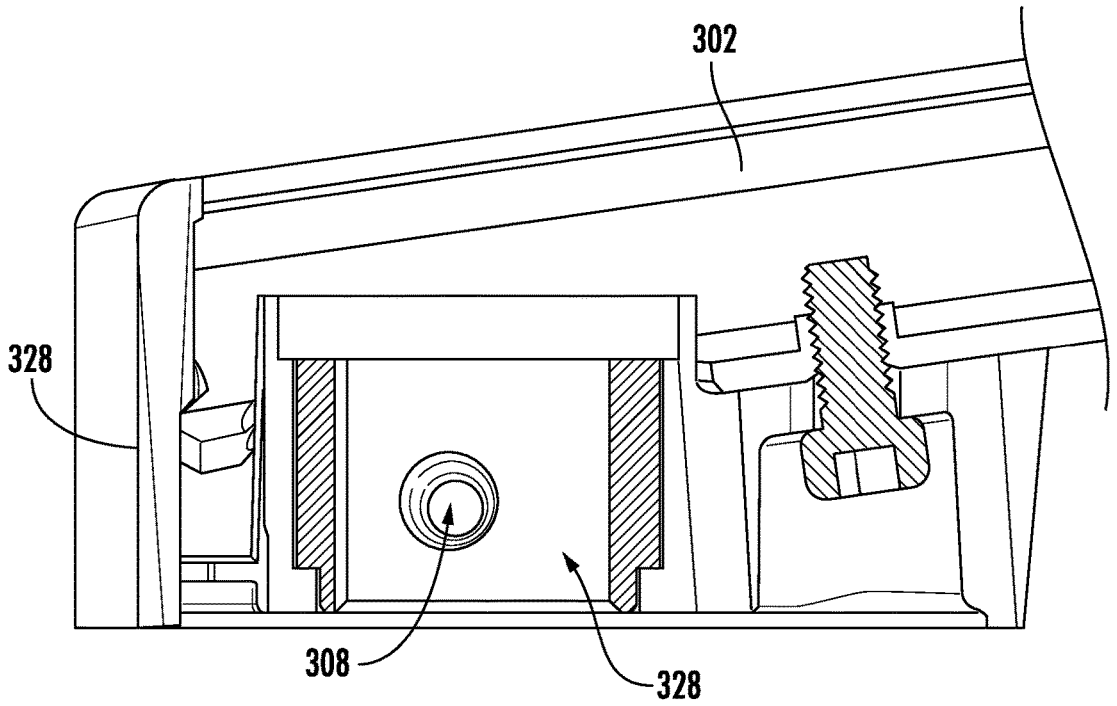
FIG. 9 provides a sectional view of a portion of a portion of an appliance handle according to exemplary embodiments of the present disclosure.
Figure 10:
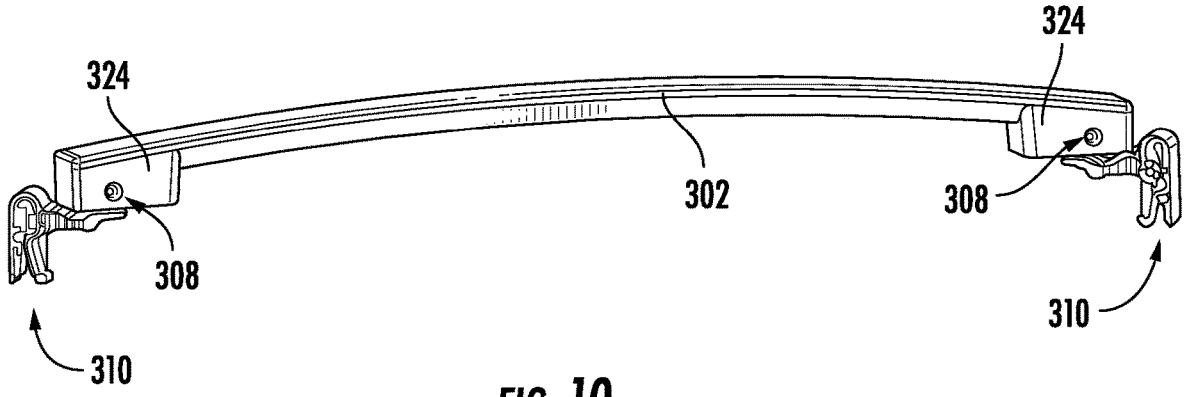
FIG. 10 provides a perspective view of an appliance handle and a pair of handle clips according to exemplary embodiments of the present disclosure.

Turning now generally to FIGS. 3 through 10, various views are provided of a transport assembly 300 according to exemplary embodiments of the disclosure. FIG. 3, in particular, illustrates an appliance handle 302 (e.g., handle 132) mounted in a transport state to a wire frame 304 (e.g., rack assembly 130). As shown, one or more handle clips 310 may be attached to appliance handle 302 (e.g., at an end thereof). For instance, pair of handle clips 310 may be provided at opposite ends of appliance handle 302. In a transport state, the handle clips 310 may be clamped and fixed on the wire frame or rack 304 (e.g., within wash chamber 106-FIG. 2); appliance handle 302 may be located above the rack 304 (e.g., all or at least portion thereof).

In some embodiments, the size of the appliance handle 302 (e.g., in a lateral or left and right direction) is larger than the size of the wire frame 304 in the left and right direction. Appliance handle 302 may be inclined forward or backward in the left and right direction. The wire frame 304 is formed by cross-connecting a plurality of rack bars 306, and the handle clip(s) 310 may be clamped on a rack bar 306, such as at the upper end of the rack 304.

Notably, in the transport state, the arrangement of the appliance handle 302 and transport assembly 300 may be beneficial to reduce the space occupied in a packaging box or prevent the damage of the appliance handle 302. Additionally or alternatively, packaging and difficulties caused by the same may be reduced.

Turning especially to FIGS. 4 through 8, various views are provided of a handle clip 310 (e.g., in isolation apart from appliance handle 302) according to exemplary embodiments of the present disclosure. Generally, the handle clip 310 is selectively movable relative to the rest of appliance 100 (FIG. 1) (e.g., during the assembly or packing process). Moreover, handle clip 310 defines a plurality of mutually orthogonal directions, including a longitudinal direction G, lateral or width direction W, and a height direction H. As shown, the handle clip 310 may further include multiple discrete segments (e.g., joined together as a continuous or unitary member). In some embodiments, the handle clip 310 include a separate mount segment 312, support segment 314, and connection segment 316. As will be described in greater detail below, the mount segment 312 may be securable to the appliance handle 302 while the connection segment 316 can be attached or secured to a portion of a wire frame 304 (e.g., rack bar 306). Support segment 314 may generally extend between mount segment 312 and connection segment 316 (e.g., joined to the same).

As shown, mount segment 312 may include an assembly post 318. The assembly post 318 may extend, for instance, upward along the height direction H. In some embodiments, the assembly post 318 extends above (e.g., at a higher position relative to the height direction than) the support segment 314 or at least a portion of the connection segment 316. Optionally, a base or platform 320 of the mount segment 312 may be provided proximal to the support segment 314 or opposite a free end of assembly post 318. Such a platform 320 may define a relatively enlarged width relative to the rest of assembly post 318. In certain embodiments, the assembly post 318 may include a general cylindrical shape or body. In some embodiments, the assembly post 318 defines a lock notch 322 that extends (e.g., inward), such as at a middle or intermediate height position of assembly post 318 (e.g., to receive or engage with a mechanical fastener, such as a clamp, screw, or bolt).

When assembled, the assembly post 318 may be received secured to or received within at least a portion of the handle. For instance, turning further to FIGS. 9 and 10, the assembly post 318 may be matched to—and selectively received within—a mated cavity 328 defined by the appliance handle 302. Such a mated cavity 328 may be defined, for instance, by an endcap 324 of appliance handle 302. In some embodiments, the appliance handle 302 (e.g., at endcap 324) further defines a fastener hole 308 (e.g., threaded hole) extending at a non-parallel angle (e.g., relative to mated cavity 328 or assembly post 318) and through which the mechanical fastener may be received. The lock notch 322 may be aligned with the fastener hole and may be used to receive or engage with the mechanical post fastener. In turn, the engagement between the mechanical post fastener and assembly post 318 may prevent the assembly post 318 from being separated from the mated cavity 328. Optionally, the platform 320 can serve as a height limit for the mount segment 312 or assembly post 318 relative to the mated cavity 328.

Returning generally to FIGS. 3 through 8, a support segment 314 may extend from the mount segment 312 away from the appliance handle 302. In some embodiments, the support segment 314 includes a longitudinal arm 330 that extends generally along the longitudinal direction G. The longitudinal arm 330 may be, for instance, perpendicular to the assembly post 318. Optionally, a concavely arranged arc-shaped portion 332 may be provided (e.g., between the mount segment 312 and the longitudinal arm 330 along the longitudinal direction G).

Opposite the mount segment 312 (e.g., relative to the longitudinal direction G), the connection segment 316 may be joined to the support segment 314 for receipt on the wire frame 304. As shown, connection segment 316 generally include a rigid tab 334 and a clamp tab 336 that can together bound (e.g., longitudinally) a portion of wire frame 304 (e.g., rack bar 306). Specifically, connection segment 316 may define a wire groove 338 to receive the wire frame 304 (e.g., rack bar 306) therein between the rigid tab 334 and clamp tab 336. Both the clamp tab 336 and the rigid tab 334 may extend in a generally downward orientation. For instance, the rigid tab 334 may extend downward (e.g., in the height direction H) from or relative to the support segment 314. Additionally or alternatively, the clamp tab 336 may extend downward (e.g., in the height direction) while being apart (e.g., longitudinally spaced apart) from the rigid tab 334.

Generally, the clamp tab 336 is deflectable relative to rigid tab 334. Thus, the clamp tab 336 may be deflected outward when receiving the rack bar 306 and returned inward (e.g., toward rigid tab 334) when rack bar 306 is either removed or received within wire groove 338. In some embodiments, a resilient arc joint 340 extends from the rigid tab 334 to the clamp tab 336. For instance, the resilient arc joint 340 may curve up and over from rigid tab 334 to clamp tab 336 opposite a free end of one or both of tabs 334, 336. Together, the clamp tab 336, the rigid tab 334, and the arc joint 340 may form a U-shaped structure such that the resilient arc joint 340 may act as an elastic hinge to bias the clamp tab 336 and rigid tab 334.

As shown, the clamp tab 336 may include a groove wall 342 disposed above (e.g., at a higher relative height than the wire groove 338 and extends toward the rigid tab 334. The groove wall 342 may, for instance, define an upper limit of wire groove 338. Separately from or in addition to groove wall 342, rigid tab 334 may define a groove shelf 344 that is disposed vertically (e.g., along the height direction H) between the groove wall 342 and the wire groove 338. A longitudinal end of the groove shelf 344 may define an end stop 346 for holding rack bar 306 within wire groove 338. Moreover, the groove shelf 344 may provide an interlocking surface with groove wall 342 such that groove wall 342 extends over at least a portion of groove shelf 344 and bounds vertical movement of rack bar 306 within wire groove 338.

In certain embodiments, one or more lateral or catch notches 348 are defined at the free end of clamp tab 336 or rigid tab 334. Specifically, the catch notches 348 may be formed as laterally open cutouts (e.g., along the width direction W). As shown, a C-shaped void may be formed by the catch notch 348. The free or unencumbered ends of clamp tab 336 or rigid tab 334 may define one or more cutouts as catch notches 348 below the wire groove 338 or opposite of the resilient arc joint 340. As an example, the clamp tab 336 may define at least one catch notch 348 with one or more legs 350 spaced apart from each other (e.g., along the height direction H). Optionally, a pair of catch notches 348 may be defined such that the free end of clamp tab 336 forms a T-post. As an additional or alternative example, the rigid tab 334 may define at least one catch notch 348 with one or more legs 350 spaced apart from each other (e.g., along the height direction H). Optionally, a pair of catch notches 348 may be defined such that the free end of rigid tab 334 forms a T-post. In some such embodiments, the T-post of the rigid tab 334 may be vertically aligned (e.g., at the same position along the height direction H) with the T-post of the clamp tab 336.

Separate from or in addition to the catch notches 348, one or more longitudinal hooks 352, 354 may be provided on at least one tab 334 or 336. In some embodiments, rigid tab 334 includes a longitudinal hook extending away from clamp tab 336. As an example, a longitudinal lower hook 352 may extend on rigid tab 334 away from clamp tab 336 below (e.g., at a lower position relative to the height direction H). The longitudinal lower hook 352 may be disposed further below the lateral notches or T-post on rigid tab 334. As an additional or alternative example, a longitudinal upper hook 354 may extend on rigid tab 334 away from clamp tab 336 below (e.g., at a lower position relative to the height direction H). The longitudinal upper hook 354 may be further disposed above longitudinal lower hook 352 or the lateral notches or T-post on rigid tab 334.

Notably, exemplary embodiments of the present disclosure may accommodate one or more zip-ties or wound fasteners to temporarily (e.g., during shipping) clamp tab 336 relative to rigid tab 334 and, thereby, further hold handle clip 310 on wire frame 304.

In some embodiments, one or more selective fasteners 356 (e.g., mechanical fasteners, such as a screw, bolt, or expandable clips) can be accommodated on handle clip 310. For instance, clamp tab 336 may define a longitudinal aperture 358 to receive a selective fastener 356. As shown, the longitudinal aperture 358 may be defined along the longitudinal direction G and extend fully through clamp tab 336, such that fastener 356 may also extend fully through longitudinal aperture 358. The longitudinal aperture 358 may be spaced apart from wire groove 338 (e.g., above wire groove 338 relative to the height direction H). In some embodiments, rigid tab 334 defines an attachment collar 362 (e.g., threaded collar) that also receives the selective fastener 356. For instance, attachment collar 362 may be aligned (e.g., longitudinally) with longitudinal aperture 358 to receive the fastener 356 with the longitudinal aperture 358. As a particular example, an threaded bolt or screw may be inserted through longitudinal aperture 358 and secured or threaded within attachment collar 362. The flared head of the threaded bolt or screw may further pull or hold the clamp tab 336 in a clamp tab 336 relative to rigid tab 334. Optionally, a recess 360 (e.g., extending inward toward rigid tab 334) may be provided about or as part of longitudinal aperture 358, such as to cradle or support the selective fastener 356 even if the attachment collar 362 is not yet engaged.

Notably, exemplary embodiments of the present disclosure may accommodate one or more selective fasteners 356 to temporarily (e.g., during shipping) clamp tab 336 relative to rigid tab 334 and, thereby, further hold handle clip 310 on wire frame 304.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A handle clip for securing an appliance handle during shipping, the handle clip comprising:

a mount segment securable to the appliance handle;

a support segment extending from the mount segment away from the appliance handle; and a connection segment joined to the support segment for receipt on a wire frame, the connection segment comprising a rigid tab extending downward relative to the support segment, a clamp tab longitudinally spaced apart from the rigid tab, the clamp tab being selectively deflectable relative to the rigid tab, and a resilient arc joint extending from the rigid tab to the clamp tab, wherein the connection segment defines a wire groove to receive the wire frame between the rigid tab and the clamp tab, wherein the clamp tab comprises a T-post at a free end disposed below the wire groove and opposite of the resilient arc joint, and wherein the clamp tab defines a longitudinal aperture perpendicular to and apart from the wire groove to receive a fastener perpendicular to the wire frame through the longitudinal aperture.

2. The handle clip of claim 1, wherein the rigid tab defines a lateral notch below the wire groove and opposite of the resilient arc joint.

3. The handle clip of claim 1, wherein the rigid tab defines a T-post vertically aligned with the T-post of the clamp tab.

4. The handle clip of claim 1, wherein the rigid tab comprises a longitudinal lower hook extending away from the clamp tab below the wire groove.

5. The handle clip of claim 4, wherein the rigid tab comprises a longitudinal upper hook extending away from the clamp tab above the longitudinal lower hook and the T-post of the clamp tab.

6. The handle clip of claim 1, wherein the clamp tab comprises a groove wall disposed above the wire groove and extending toward the rigid tab, and wherein the rigid tab defines a groove shelf disposed vertically between the groove wall and the wire groove.

7. The handle clip of claim 1, wherein the mount segment comprises an assembly post to be received within a mated cavity of the appliance handle.

8. The handle clip of claim 7, wherein the assembly post extends upward and opposite of the T-post of the clamp tab.

9. The handle clip of claim 1, wherein the rigid tab defines an attachment collar aligned with the longitudinal aperture to receive the fastener with the longitudinal aperture.

10. The handle clip of claim 9, wherein the longitudinal aperture and attachment collar are disposed above the wire groove.

11. A handle clip for securing an appliance handle during shipping, the handle clip comprising:

a mount segment securable to the appliance handle;

a support segment extending from the mount segment away from the appliance handle;

a connection segment joined to the support segment for receipt on a wire frame, the connection segment comprising a rigid tab extending downward relative to the support segment, a clamp tab longitudinally spaced apart from the rigid tab, the clamp tab being selectively deflectable relative to the rigid tab, and a resilient arc joint extending from the rigid tab to the clamp tab, wherein the connection segment defines a wire groove to receive the wire frame between the rigid tab and the clamp tab, wherein the clamp tab defines a longitudinal aperture perpendicular to and apart from the wire groove to receive a fastener perpendicular to the wire frame through the longitudinal aperture, and wherein the rigid tab defines an attachment collar aligned with the longitudinal aperture to receive the fastener with the longitudinal aperture, the attachment collar being a threaded attachment collar.

12. The handle clip of claim 11, wherein the longitudinal aperture and attachment collar are disposed above the wire groove.

13. The handle clip of claim 11, wherein the clamp tab defines at least one notch apart from the longitudinal aperture below the wire groove and opposite of the resilient arc joint.

14. The handle clip of claim 11, wherein the rigid tab defines a lateral notch below the wire groove and opposite of the resilient arc joint.

15. The handle clip of claim 14, wherein the rigid tab comprises a longitudinal upper hook extending away from the clamp tab above the lateral notch of the rigid tab.

16. The handle clip of claim 11, wherein the rigid tab comprises a longitudinal lower hook extending away from the clamp tab below the wire groove.

17. The handle clip of claim 16, wherein the rigid tab comprises a longitudinal upper hook extending away from the clamp tab above the longitudinal lower hook.

18. The handle clip of claim 11, wherein the clamp tab comprises a groove wall disposed above the wire groove and extending toward the rigid tab, and wherein the rigid tab defines a groove shelf disposed vertically between the groove wall and the wire groove.

19. The handle clip of claim 11, wherein the mount segment comprises an assembly post to be received within a mated cavity of the appliance handle.

20. The handle clip of claim 19, wherein the assembly post extends upward and opposite of the rigid tab.

* * * * *